US006779412B2

(12) United States Patent
Viot

(10) Patent No.: US 6,779,412 B2
(45) Date of Patent: Aug. 24, 2004

(54) LIQUID SAMPLING PIPETTE WITH ADJUSTABLE EJECTOR

(75) Inventor: Francois Viot, Auvers-sur-Oise (FR)

(73) Assignee: Gilson S.A.S, Villiers le Bel (FR)

( * ) Notice: Subject to any disclaimer, the term of this patent is extended or adjusted under 35 U.S.C. 154(b) by 0 days.

(21) Appl. No.: 10/240,986

(22) PCT Filed: Apr. 9, 2001

(86) PCT No.: PCT/FR01/01070

§ 371 (c)(1),
(2), (4) Date: Feb. 19, 2003

(87) PCT Pub. No.: WO01/76750

PCT Pub. Date: Oct. 18, 2001

(65) Prior Publication Data

US 2003/0159526 A1 Aug. 28, 2003

(30) Foreign Application Priority Data

Apr. 7, 2000 (FR) ..... 00 04466

(51) Int. Cl.[7] ..... B01L 3/02

(52) U.S. Cl. ..... 73/864.14; 73/864.23; 73/864.24

(58) Field of Search ..... 73/864.24, 864.23, 73/864.14

(56) References Cited

U.S. PATENT DOCUMENTS 3,864,045 A * 2/1975 Hudson ..... 401/1
4,813,426 A * 3/1989 Haber et al. ..... 600/576
5,147,300 A * 9/1992 Robinson et al. ..... 604/97.03
5,983,733 A 11/1999 Strandberg et al.

FOREIGN PATENT DOCUMENTS

EP 0566 939 10/1993
WO WO 9311870 6/1993

* cited by examiner

*Primary Examiner*—Hezron Williams
*Assistant Examiner*—Katina Wilson
(74) *Attorney, Agent, or Firm*—Foley & Lardner

(57) ABSTRACT

The invention concerns a pipette comprising a body, an arm mobile relative to the body along a longitudinal direction to eject a tip fixed to the body and a push button controlling the movement of the arm. The pipette is designed such that the push button is mobile relative to the body in a plane perpendicular to the longitudinal direction by being able to take up any one particular position in a continuous range of positions in said plane and enabling to control the movement of the arm in said any particular position.

16 Claims, 5 Drawing Sheets

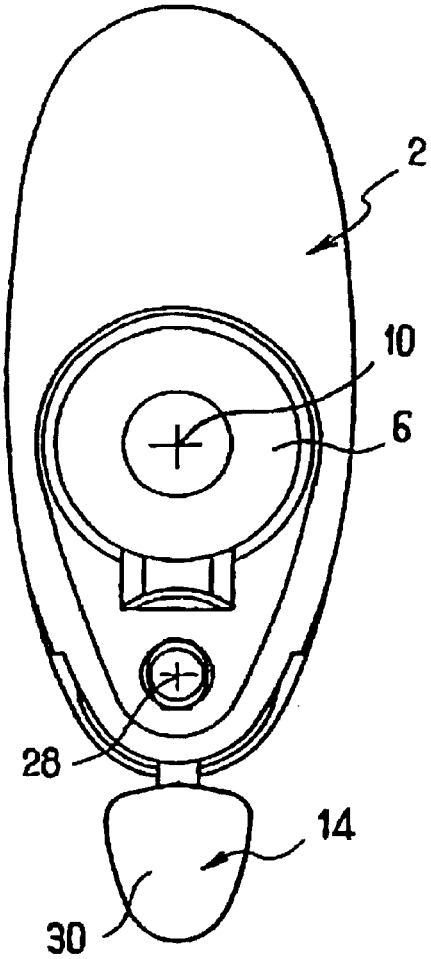
FIG_8
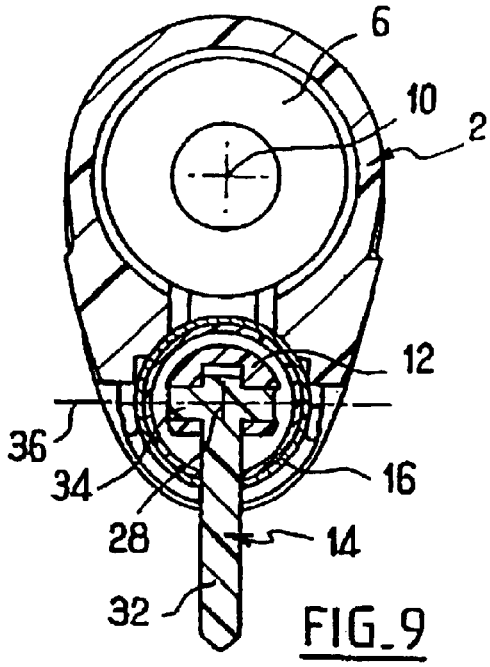
FIG_9
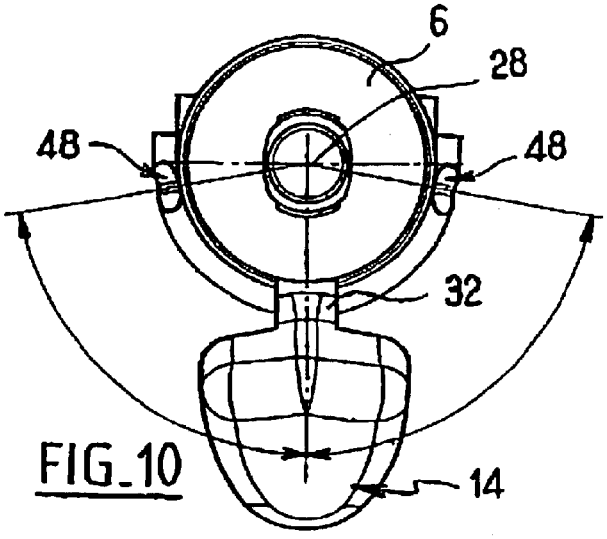
FIG_10
FIG_11
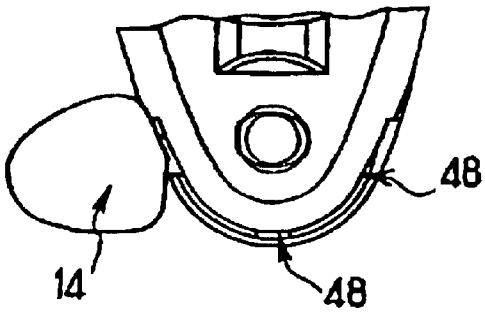
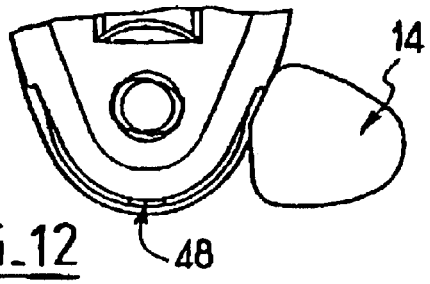
FIG_12

LIQUID SAMPLING PIPETTE WITH ADJUSTABLE EJECTOR

The invention relates to liquid sampling pipettes.

Document EP-0 566 939 discloses a pipette comprising a body and an ejector arm which can be moved by sliding along the body in order to separate from the pipette a cone fastened by friction at the lower part thereof. The pipette comprises an ejector control button, allowing the arm to be lowered by pressure on the button.

The ejector button lies behind the pipette in its median central plane of symmetry. Now, such a position may eventually prove to be awkward in the long term for actuating the button.

One aim of the invention is to provide a pipette making it more comfortable to control the ejector.

For the purpose of achieving this aim, provision is made according to the invention for a sampling pipette comprising a body, an arm which can be moved with respect to the body in a longitudinal direction in order to eject a cone fixed to the body and a button for controlling the movement of the arm, the pipette being arranged so that the button can be moved with respect to the body in a plane perpendicular to the longitudinal direction by being able to occupy any position from a continuous range of positions in this plane and by making it possible to control the movement of the arm in said any position.

Thus, the user may choose the position of the button which is most suitable for him. This choice-may be made not only between the left and right positions depending on which hand holds the pipette, but in addition, this choice may be made from an infinite number of positions at the user's choice. The user may therefore adapt the pipette as desired for comfortable handling.

Furthermore, the invention will be able to have at least one of any of the following characteristics:

- the button is mounted so that it can rotate with respect to the body in said plane;
- the button is arranged in order to produce a sliding support on the arm during movement of the button in said plane;
- the pipette comprises means of identifying at least one predetermined position of the button with respect to the body from said range;
- the button is arranged in order to produce a sliding support on the arm during movement of the arm when the button occupies the same position in said range;
- the button is mounted so that it can rotate with respect to the body about an axis perpendicular to the longitudinal direction;
- the pipette comprises an intermediate part mounted so that it can rotate with respect to the body about an axis parallel to the longitudinal direction, the button being mounted so that it can rotate with respect to the intermediate part about an axis perpendicular to the longitudinal direction;
- the button is directly connected to the intermediate part;
- the intermediate part is mounted so that it can rotate with respect to the arm about the axis parallel to the longitudinal direction;
- the intermediate part is directly connected to the body;
- the pipette comprises a connecting part which can be moved with respect to the body along an axis parallel to the longitudinal direction, the button being able to move with respect to this part through an opening in this part;

- the connecting part can rotate with respect to the arm about the axis parallel to the longitudinal direction;
- the connecting part can rotate with respect to the intermediate part about the axis parallel to the longitudinal direction;
- the connecting part is directly connected to the intermediate part;
- the connecting part is directly connected to the arm.

Other characteristics and advantages of the invention will become further apparent in the following description of a preferred embodiment given by way of nonlimiting example. In the appended drawings:

FIG. 8 is a top view of the pipette of FIG. 1;

FIG. 9 is a view in horizontal section along the plane IX—IX of the pipette of FIG. 4;

Figure 1:
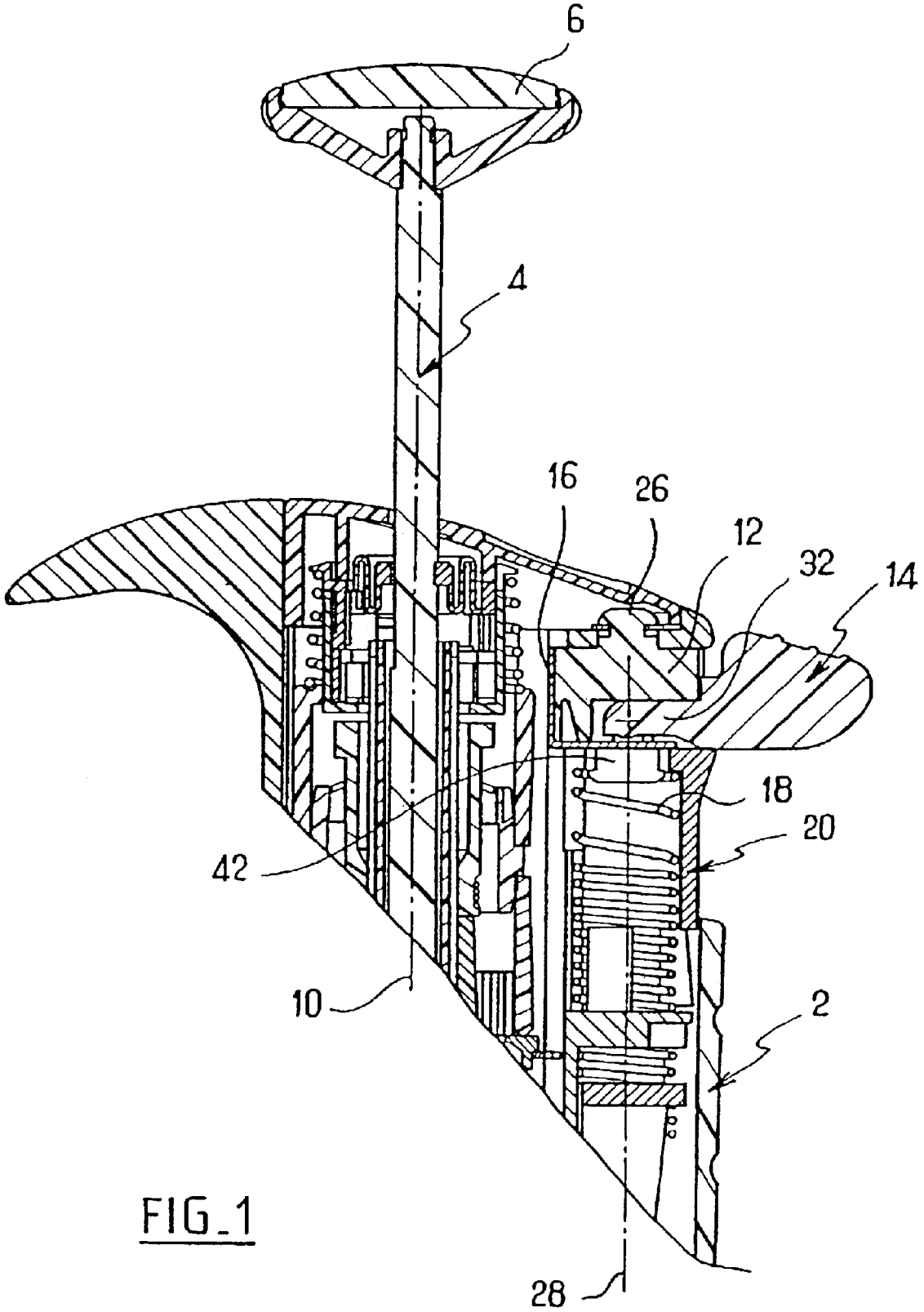
FIG. 1 is a partial view in vertical axial section of the upper part of a pipette according to the invention.
Figure 2:
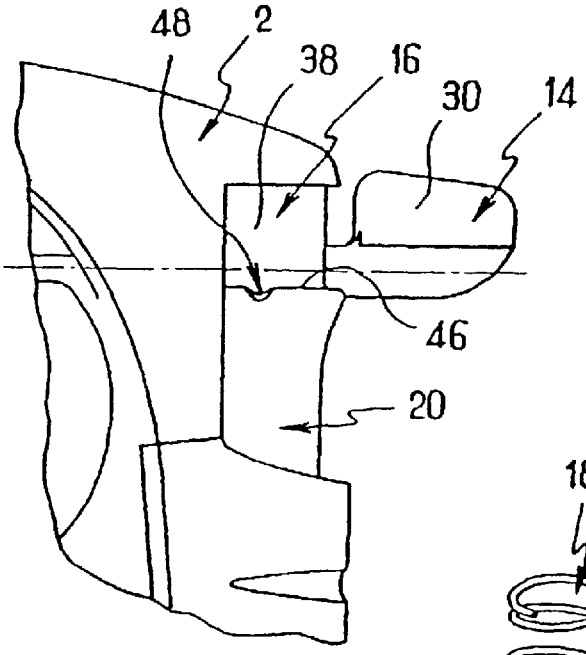
FIG. 2 is a partial right-hand side view of the pipette of FIG. 1.

FIG. 10 is a partial view of the pipette similar to FIG. 8 showing the angular clearance of the ejector button in a horizontal plane; and FIGS. 11 and 12 are two views similar to FIG. 10 illustrating two extreme left and right positions of the button The pipette according to the embodiment illustrated in FIG. 1 is a sampling pipette with a single channel, many aspects of which are known per se and will not be described here in detail. In particular, the pipette comprises a stem 4 of axis 10 surmounted by a sampling control button 6, controlling the sliding movement of a piston along the axis 10 in a lower cavity of the pipette for sucking a liquid sample into this cavity or expelling it out of the latter.

The lower point of the pipette is capable of accommodating, fixed by friction, a disposable cone through which the sampled liquid passes. The pipette comprises means for adjusting the volume to be sampled, which may be of a conventional type.

The pipette comprises an ejector mechanism making it possible to push the cone downward in the longitudinal direction, in order to separate it from the pipette. The lower part of this mechanism is known per se. Only its upper part will be described.

Figure 3:
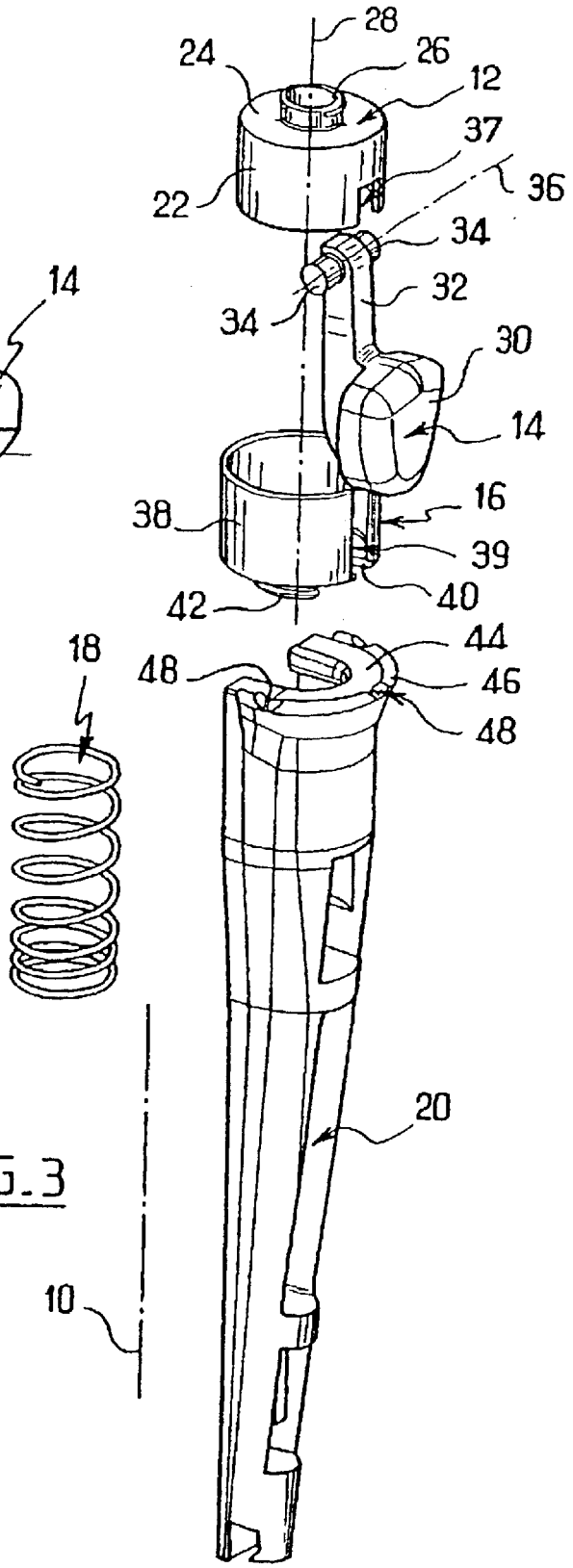
FIG. 3 is an exploded perspective view of the upper part of the ejector mechanism of the pipette of FIG. 1.
Figure 4:
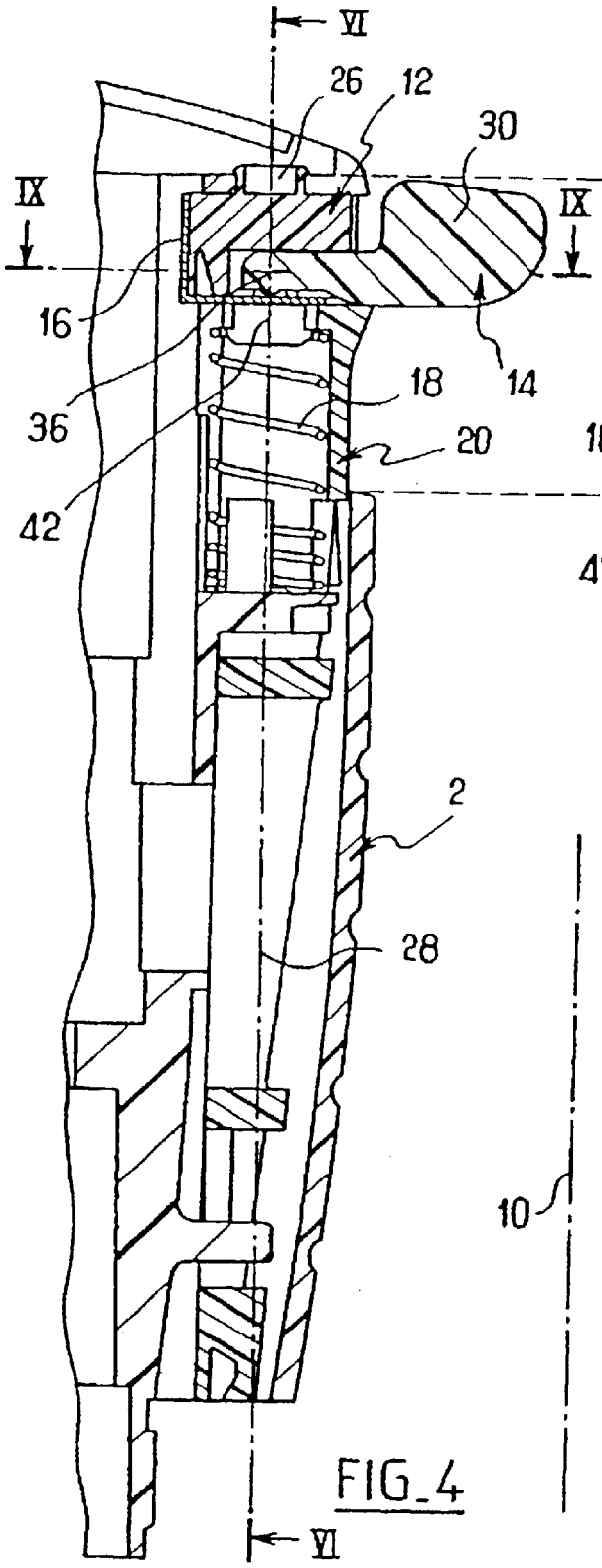
FIGS. 4 and 5 are two views similar to FIG. 1, showing the high and low positions, respectively, of the ejector.
Figure 5:
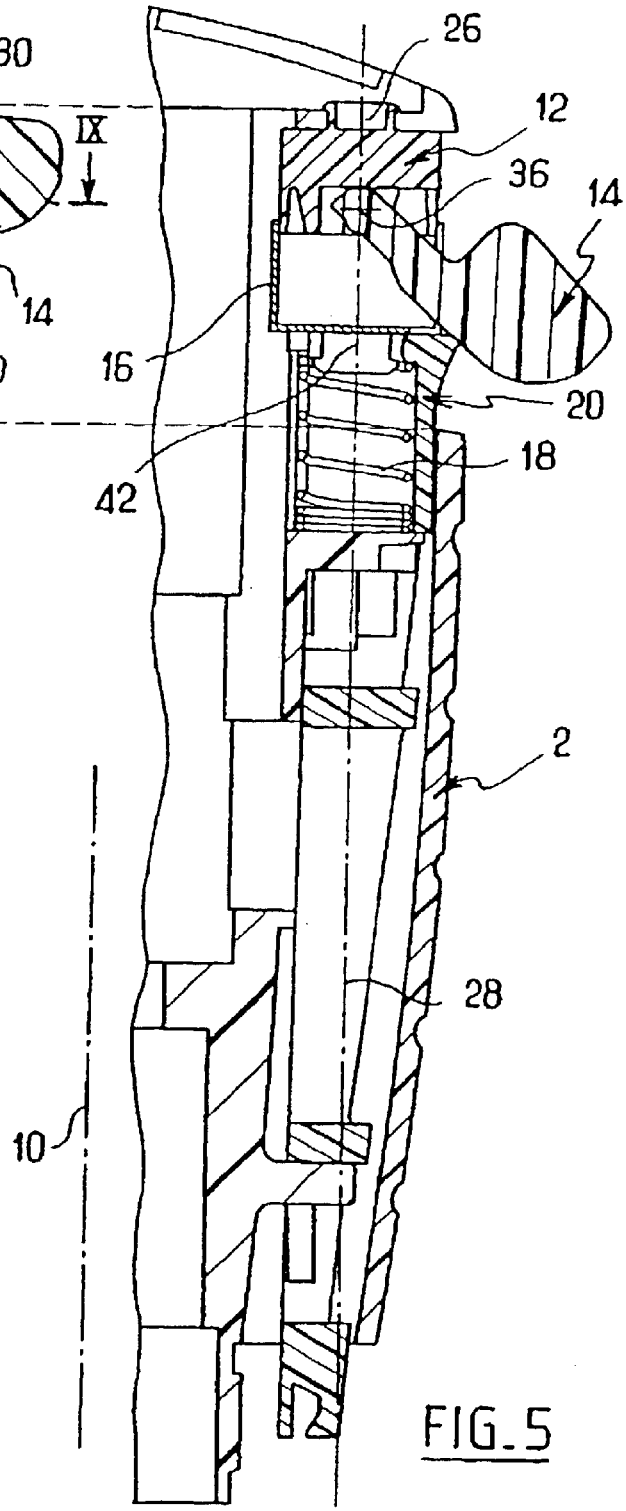
Figure 6:
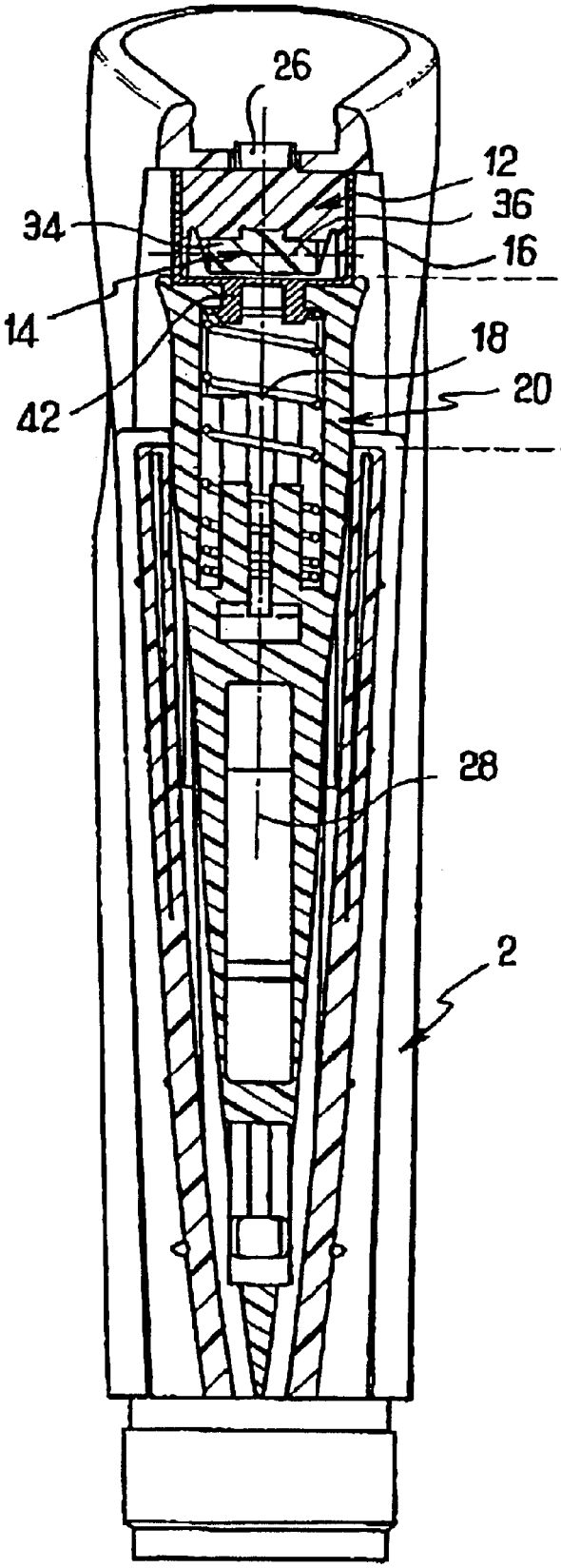
FIG. 6 is a view in vertical axial section along the plane VI—VI of the pipette of FIG. 4.
Figure 7:
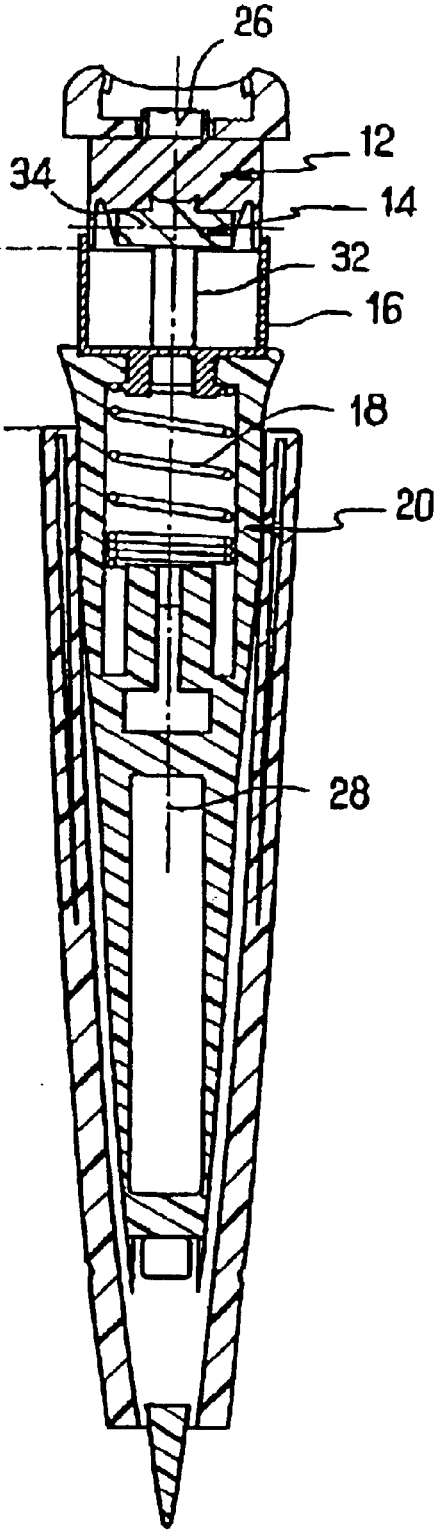
FIG. 7 is a view similar to FIG. 6 showing the ejector in the low position.

With reference especially to FIG. 3, the mechanism comprises an upper lid 12, an ejector control button 14, a pivot cover 16, a spring 18 and an actuator 20.

The upper lid 12 comprises a cylindrical lateral face 22 and an upper plane circular face 24. The upper face is surmounted at its center by a finger 26 accommodated in an orifice of the body 2 and held in place by a washer. By virtue of this finger, the lid 12 can rotate with respect to the body 2 about a vertical axis 28 parallel to the axis 10, and fixed so that it can slide with respect to the body.

The button 14 comprises a flattened actuating part 30, a leg 32 extending laterally parallel to the actuating part and a shaft 34 perpendicular to the leg and emerging from each side thereof. The shaft is accommodated so that it can rotate in the upper lid 12. The button is thus articulated to the lid about a horizontal axis 36 perpendicular to the vertical axes 10 and 28 and secant with the axis 28. The lateral wall 22 of the lid has a cutaway 37 in which the leg 32 of the button lies when it is in the horizontal position. The lid is open downward.

The pivot cover 16 comprises a cylindrical wall 38 open upward and a circular plane lower wall 40 from which a finger 42 projects downward. The lid 12 lies in the pivot cover 16 with their lateral faces 22 and 38 opposite each other.

The wall 38 has a cutaway 39 over its entire height placed in coincidence with the cutaway 37 of the lid, and through which the leg 32 passes. The pivot cover 16 can slide with respect to the lid 12 along the axis 28.

The actuator 20 has, in the upper part, a plane wall 44 cut away from its front edge to its center. This cutaway accommodates the finger 42 lying at the center of the wall 44. The lower end of the finger is widened in order to lock the translation of the pivot cover 16 with respect to the actuator 20 along the axis 28. The pivot cover 16 can therefore rotate with respect to the actuator about the axis 28. It bears downward on the wall 44 of the actuator. The actuator 20 has a "U"-shaped collar 46 lying at the edge of the wall 44, to the back, left and right thereof, and projecting upward with respect to the wall 44. The collar comprises notches 48, for example three of them as illustrated, or five of them, cutting downward into the collar. One of the notches lies in the middle of the rear. The other two lie to the left and to the right, respectively, of the wall 44. The leg 32 bears on the collar 46 and may enter one of the notches 48.

The spring 18 is housed in the actuator 20, as illustrated in FIGS. 4 to 7. It bears by its lower end on the body 2 and by its upper end under the wall 44 in order to urge the actuator upward. The actuator 20 can slide in the body 2 along the axis 28. It is rigidly connected to a lower stem (not illustrated) intended to contact the cone to be ejected.

By virtue of the structure which has just been described, two series of movements are possible.

First of all, with reference to FIGS. 10 to 12, the button 14 can rotate with respect to the body 2 about the axis 28, that is to say in a horizontal plane perpendicular to the axis 28. It may be moved on either side of its rear median position by 80° on each side. The left and right ends of these clearances, illustrated in FIGS. 11 and 12, correspond to accommodating the branch 32 in the lateral notches 48. During this rotational movement, the button 14, the upper lid 12 and the pivot cover 16 rotate as one about the axis 28. The actuator 20 remains stationary. The button may be placed in any position from the clearance range of 160°, outside the notches or in them.

Moreover, from whatever position of the button 14 with respect to the body 2 about the axis 28, the button may be actuated downward by the user on the part 30. This action leads to the button to rotate about the horizontal axis 36, which causes vertical sliding along the axis 28 of the pivot cover 16 and of the actuator 20. During this movement, the leg 32 bears on the same point of the collar 46 by sliding over the latter in a plane radial to the axis 28. The upper lid 12 remains immobile. The descent of the actuator makes it possible to eject the cone. Consequently, the cone may be ejected whatever the position of the button about the axis 28, especially with the button to the left, to the right or to the rear of the pipette.

In practice, the two movements which have just been described may be combined at will during movement of the button. The user may freely choose the position of the button at rest and its position during the movement of ejecting a cone.

It can be seen that this mechanism gives great freedom of movement and of positioning for the button while having a relatively simple construction. It is easy to manufacture and to assemble.

Furthermore, since the point of sliding support for the button 14 on the actuator 20 lies between the actuating part 30 and the shaft 34, the button acts as a lever reducing the force to be supplied in order to eject the cone.

The notches 48 constitute means of identifying preferred positions of the button on the collar (in this case, rear, left and right).

It would be possible to implement the characteristics relating to the sliding support of the button on the actuator during ejection, independently of those relating to the mobility of the button with respect to the body in a plane perpendicular to the direction 10.

What is claimed is:

1. A sampling pipette comprising:

a body;

an actuator which can be moved with respect to the body in a longitudinal direction in order to eject a cone fixed to the body; and a button for controlling the movement of the actuator, the pipette being arranged so that the button can be moved with respect to the body in a plane perpendicular to the longitudinal direction by being able to occupy any position from a continuous range of positions in this plane and by making it possible to control the movement of the actuator in said any position.

2. The pipette as claimed in claim 1, characterized in that the button is arranged in order to produce a sliding support on the actuator during movement of the button in said plane.

3. The pipette as claimed in claim 1, wherein at least one predetermined position of the button is set with respect to said range.

4. The pipette as claimed in claim 1, characterized in that the button is arranged in order to produce a sliding support on the actuator during movement of the actuator when the button occupies the same position in said range.

5. The pipette as claimed in claim 1, characterized in that it comprises an intermediate part mounted so that it can rotate with respect to the body about an axis parallel to the longitudinal direction, the button being mounted so that it can rotate with respect to the intermediate part about an axis perpendicular to the longitudinal direction.

6. The pipette as claimed is claim 5, characterized in that the button is directly connected to the intermediate part.

7. The pipette as claimed in claim 5, characterized in that the intermediate part is mounted so that it can rotate with respect to the actuator about the axis parallel to the longitudinal direction.

8. The pipette as claimed in claim 5, characterized in that the intermediate part is directly connected to the body.

9. The pipette as claimed in claim 5, characterized in that the connecting part can rotate with respect to the intermediate part about the axis parallel to the longitudinal direction.

10. The pipette as claimed in claim 9, characterized in that the connecting part is directly connected to the intermediate part.

11. The pipette as claimed in claim 1, characterized in that it comprises a connection part which can be moved with respect to the body along an axis parallel to the longitudinal direction, the button being able to move with respect to this part through an opening in this part.

12. The pipette as claimed in claim 11, characterized in that the connecting part can rotate with respect to the actuator about the axis parallel to the longitudinal direction.

13. The pipette as claimed in claim 11, wherein the connecting part is directly connected to the actuator.

14. A sampling pipette comprising:

a body;

an actuator which can be moved with respect to the body in a longitudinal direction in order to eject a cone fixed to the body; and a button for controlling the movement of the actuator, wherein the pipette is arranged so that the button can be moved with respect to the body in a plane perpendicular to the longitudinal direction, and further wherein the button can be moved about an axis perpendicular to the longitudinal direction.

15. The pipette as claimed in claim 14, wherein the button can be moved in the plane perpendicular to the longitudinal direction and about the perpendicular axis simultaneously.

16. The pipette as claimed in claim 14, wherein the button can be moved in the plane perpendicular to the longitudinal direction and about the perpendicular axis sequentially.

* * * * *